US008328019B2

(12) United States Patent
Dermo

(10) Patent No.: US 8,328,019 B2
(45) Date of Patent: Dec. 11, 2012

(54) COMBINATION WASTE RECEPTACLE AND TOILET TISSUE ROLL STORAGE DEVICE

(76) Inventor: Mario Dermo, Warren, MI (US)

( * ) Notice: Subject to any disclaimer, the term of this patent is extended or adjusted under 35 U.S.C. 154(b) by 210 days.

(21) Appl. No.: 12/557,890

(22) Filed: Sep. 11, 2009

(65) Prior Publication Data

US 2011/0062035 A1 Mar. 17, 2011

(51) Int. Cl.
*B65D 69/00* (2006.01)

(52) U.S. Cl. ..... 206/581; 206/486; 206/734; 206/409; 220/908; 220/503; D7/537

(58) Field of Classification Search ..... 206/581, 206/734, 486; 220/503, 505, 628, 23.83, 220/675, 908.1, 908; D7/619.1, 624.1, 624.2, D7/624.3, 524, 537; D34/1–11; D19/75, D19/77, 81

See application file for complete search history.

(56) References Cited

U.S. PATENT DOCUMENTS

| | | | | | |
|---|---|---|---|---|---|
| 3,300,082 | A | * | 1/1967 | Patterson | 220/495.07 |
| 5,249,669 | A | * | 10/1993 | Resnick et al. | 206/740 |
| D344,425 | S | * | 2/1994 | Balanesi | D6/519 |
| 5,458,259 | A | * | 10/1995 | Falk | 221/22 |
| 5,704,565 | A | | 1/1998 | Cheng | |
| 5,738,239 | A | * | 4/1998 | Triglia | 220/495.07 |
| 5,887,298 | A | | 3/1999 | Semidey | |
| 6,431,405 | B2 | * | 8/2002 | Irwin | 222/192 |
| 6,439,386 | B1 | * | 8/2002 | Sauer et al. | 206/494 |
| D464,909 | S | * | 10/2002 | Dahlson | D11/155 |
| D554,320 | S | * | 10/2007 | Williams | D34/1 |
| D572,532 | S | * | 7/2008 | Despres | D7/511 |
| 7,708,188 | B2 | * | 5/2010 | Stravitz et al. | 232/43.2 |
| D627,181 | S | * | 11/2010 | Lehr et al. | D6/515 |

* cited by examiner

*Primary Examiner* — David T. Fidei
*Assistant Examiner* — Raven Collins
(74) *Attorney, Agent, or Firm* — Young Basile Hanlon & MacFarlane PC

(57) ABSTRACT

A dual purpose waste receptacle and toilet tissue roll storage device in which the toilet tissue storage area is arranged below the waste receptacle and provides a base on which the dual purpose device stands in use. A flanged top provides for convenient handling. The device may be made in one or two pieces.

4 Claims, 4 Drawing Sheets

COMBINATION WASTE RECEPTACLE AND TOILET TISSUE ROLL STORAGE DEVICE

FIELD OF THE INVENTION

This invention relates to waste or trash receptacles and, more particularly, to a waste receptacle with an integral storage compartment for one or more rolls of toilet tissue or the like.

BACKGROUND OF THE INVENTION

Almost every home bathroom is equipped with a waste receptacle, usually made of molded plastic, and available in numerous colors, sizes and shapes. In many bathrooms it is also common to find one or more spare rolls of toilet tissue stacked near a toilet.

SUMMARY OF THE INVENTION

The present invention is a waste receptacle having integrated therewith a storage area sized to accommodate one or more spare conventionally sized rolls of toilet tissue.

As used herein, the terms "integral" and "integrated" mean physically combined or attached and conventionally, but not necessarily, one piece; i.e., both one-piece and two-piece structural arrangements are contemplated as hereinafter described.

According to the illustrative embodiments disclosed herein, the invention may comprise a molded plastic waste receptacle to which downwardly depending side and back walls have been attached below the sidewall structure of the waste receptacle so as to define a storage area below the waste receiving volume. The integrated structure sits on its own base which is below the floor of the waste receptacle. The storage area is sized to receive one or more spare rolls of conventionally-sized toilet tissue or similarly sized articles such as small cube-shaped facial tissue dispenser boxes.

The invention, thus, serves two purposes. In a single device which is light, easily handled, easily cleaned, the invention provides a waste or trash receptacle and eliminates the need for stacking spare toilet tissue rolls in a corner near a toilet in a home or institutional bathroom.

For a full description of the invention and various alternative embodiments thereof, reference should be made to the accompanying specification taken with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
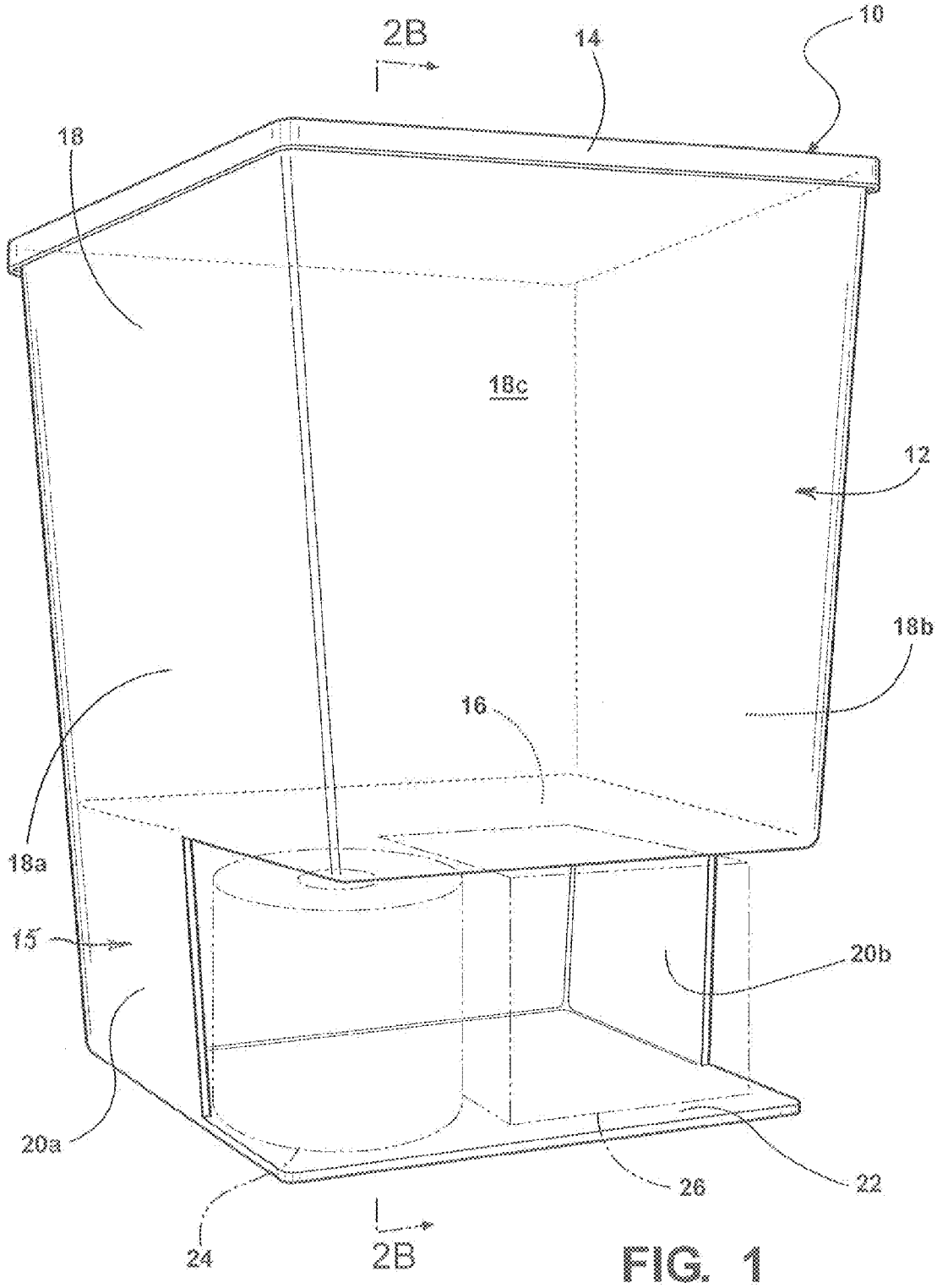
FIG. 1 is a perspective view of the first embodiment of the invention providing storage space for two conventionally-sized rolls of toilet tissue immediately below a substantially rectangular waste receptacle having a flanged top.
Figure 2B:
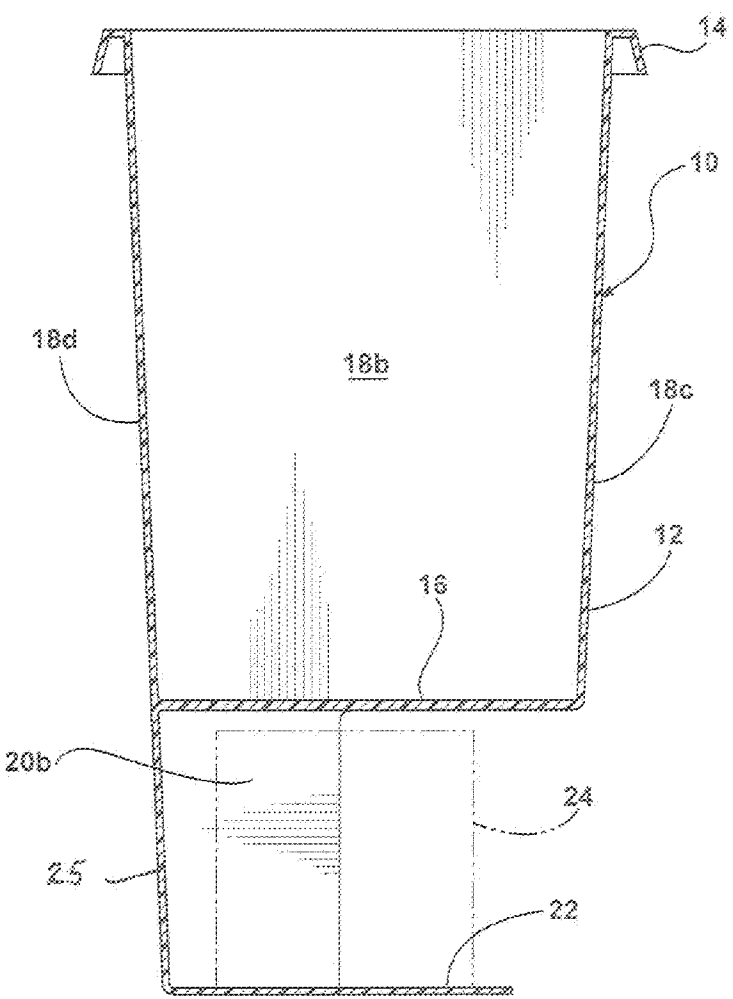
FIGS. 2A and 2B are side views of the device of FIG. 1, one of which is in section.
Figure 2A:
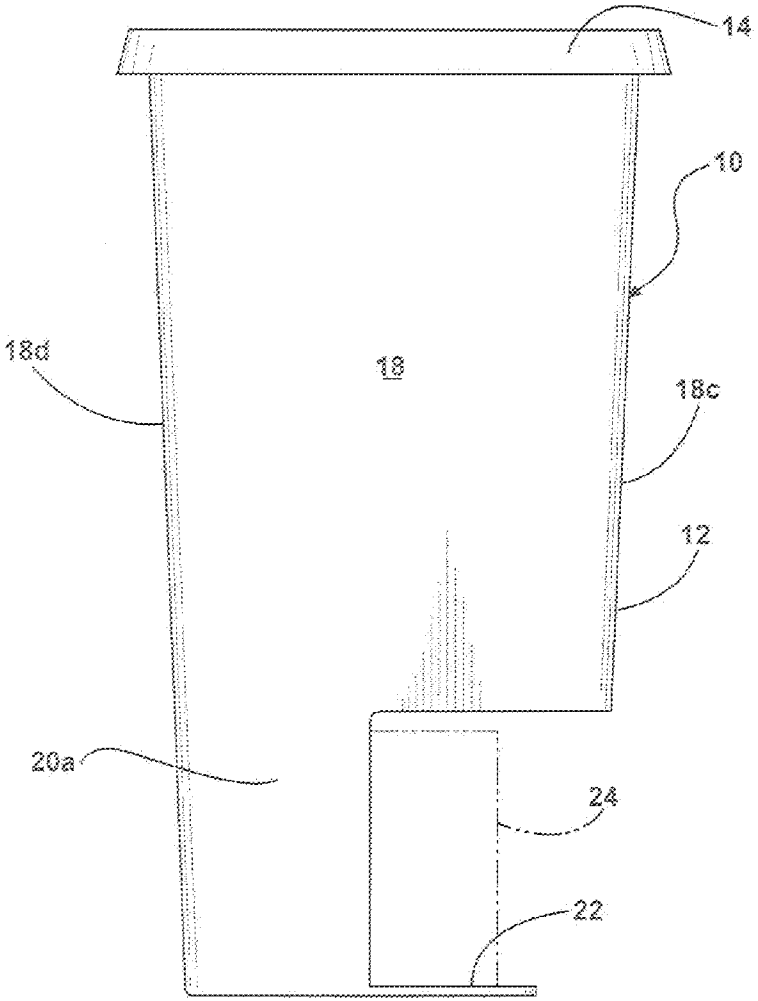

Referring first to FIGS. 1, 2A and 2B, there is shown a molded plastic wastebasket/toilet tissue storage receptacle 10 comprising a generally rectangular upper waste receptacle 12 and a lower storage area 15 for spare toilet tissue rolls. The waste receptacle 12 has a top peripheral flange 14 around an open top and a floor 16 integral with a sidewall structure 18. In the case of a generally rectangular device having softly radiused corners as shown in FIGS. 1 and 2, the sidewall structure 18 actually has four definable planes 18*a*, 18*b*, 18*c* and 18*d*, all of which are integral with the floor 16.

Extending downwardly and co-planarly with the side planes 18*a* and 18*b* are storage compartment sidewalls 20*a* and 20*b* which extend to and are integral with a base 22 and a back wall 25 which is effectively an extension of the waste receptacle back plane 18*d*. The vertical space between the base 22 and the floor 16 is approximately 5 inches. The width of the storage volume between the sidewall structures 20*a* and 20*b* approximately 10-12 inches. This volume is such as to enable the storage area 15 below the waste receptacle 12 to accommodate two spare conventionally-sized rolls of toilet tissue 24 or, as shown in FIG. 1, one spare roll 24 of toilet tissue and a cubicle box 26 of facial tissue in side-by-side relationship. As best shown in FIG. 2, the sidewall structures 20*a*, 20*b* are abbreviated laterally so as to permit a portion of the roll 24 to stand out in front of the sidewall structures 20*a*, 20*b* for easy, manual accessibility as well as visibility. While the sidewalls 20*a* and 20*b* and the back wall 25 are shown solid, they may be made up of strips, spokes, or a web-like structure as described.

The top flange 14 allows the device 10 to be easily picked up for emptying and cleaning but a rimless or flangeless device can also be employed. Alternatives to the flange include molded side handles and/or slots to facilitate manual handling of the device 10. Molded polyethylene is the preferred material of construction but many other plastics and metals can be used with equal facility, albeit metals likely add to the cost.

Figure 3:
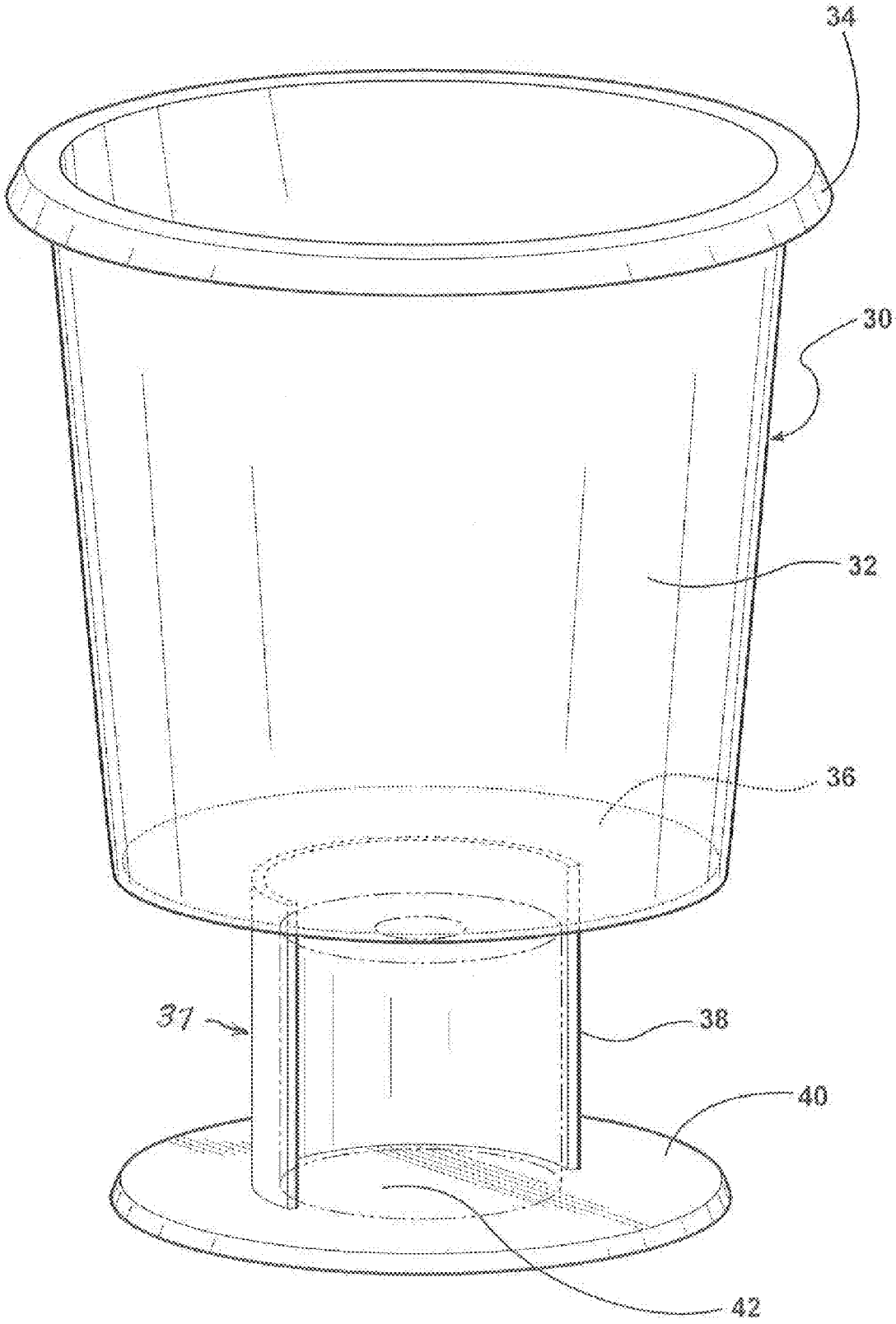
FIG. 3 is a perspective view of an alternative embodiment showing a waste receptacle having a circular cross-section with storage immediately below the waste receptacle for a single spare roll of toilet tissue.

Referring now to FIG. 3, an alternative embodiment is shown in the form of a combination device 30 which includes both a generally cylindrical waste receptacle 32 and a storage structure 37. The receptacle 32 has a flanged open top 34 and a floor 36. Being circular, there is a single, sidewall structure to the device 30 but, as explained above, shape is a secondary consideration and may vary between oval, elliptical, rectangular, square, round, and other polyhedron shapes. A slight taper is preferable for molding purposes but a pure straight-sided device can also be made.

Immediately below the waste receptacle 32 is a toilet tissue storage structure 37 defined by a semi-circular sidewall 38 which is integral with the floor 36 and has an integral base 40 on which the device 30 stands in a stable fashion. The sidewall structure 38 is such as to define a storage area for a conventionally sized roll 42 of toilet tissue. Again, the sidewall structure 38 is such as to allow the roll 42 of toilet tissue to protrude forwardly therefrom for easy access.

The sidewall structure 38 may be continuous all the way around its perimeter but may also be slotted and/or made as a series of vertical spokes and the like. The shape of the base 40 preferably matches that of the waste receptacle 32 but may be also be square or oval. Again, the top flange 34 is provided for convenience and handling but may be eliminated in favor of one or more side mounted lifting handles and/or one or more slots to receive user's fingers. The vertical height of the storage area defined by the sidewall 30 is approximately 5 inches and the overall height of the device 30 is on the order of 18 to 24 inches. These dimensions are approximate and may vary if larger devices are desired for institutional or household use.

Figure 4:
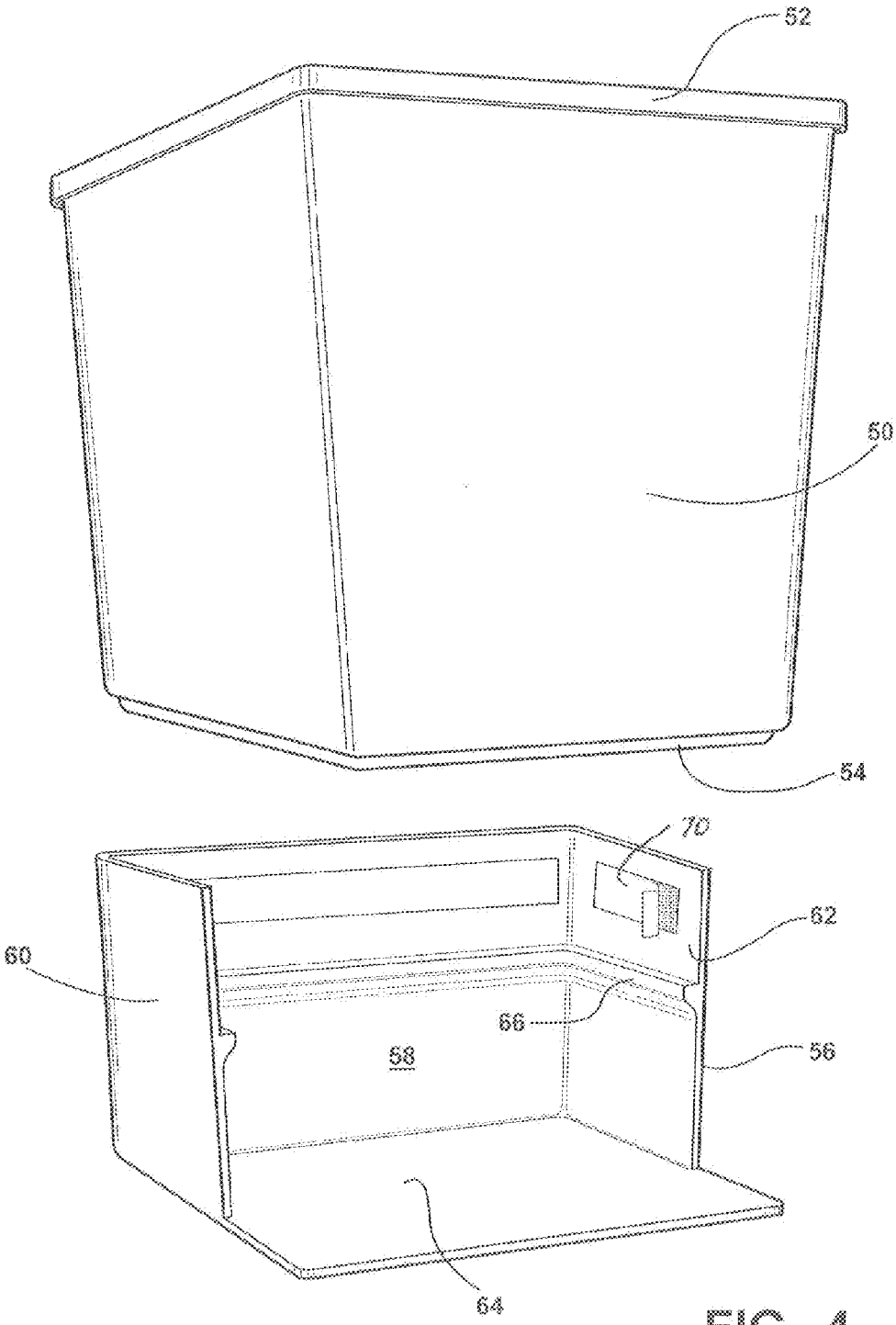
FIG. 4 is an exploded view of a second alternative embodiment in which the waste receptacle and the attachable storage device are made in two pieces.

Referring now to FIG. 4, a third embodiment is shown in the form of a waste receptacle 50 as a stand-alone structure having an open top defined by a flange 52 and a protruding base 54. The waste receptacle 50 is injection molded of suitable plastic such as polyethylene or polypropylene and, in the illustrated embodiment, is generally rectangular so as to define a sidewall structure and a floor. Formed as a separate component is a storage device 56 having a back wall 58 and sidewalls 60, 62 which are integral with a base 64. A ridge 66 is formed continuously around the interior surfaces of the sidewalls 60, 62 as well as the back wall 58 to define a stop whereby one may insert the waste receptacle into the storage device 56 until the base 54 of the waste receptacle 50 engages the ridge 66. This places the floor of the waste receptacle 50 approximately 5 inches above the floor 64 of the accessory 56, thus defining a spare toilet tissue or facial tissue storage area similar to that illustrated in FIG. 1, the dimensions being such as to accommodate, in this case, two spare rolls of conventionally sized toilet tissue in side-by-side fashion or two cubicle boxes of facial tissue or a combination of toilet tissue and facial tissue box.

The fit between the waste receptacle 50 and the accessory 56 is preferably snug so that the two may be lifted together. Alternatively, two-sided tape 70 or detents may be used to provide a more secure and semi-permanent joinder of the two pieces.

It will be understood that the shapes, sizes, materials of constructions and details of manufacture described herein are illustrative rather than limiting in nature. For a definition of the invention, reference should be had to the following claims.

What is claimed is:

1. A dual purpose molded plastic waste receptacle and toilet tissue storage device comprising:

an open top tapered cylindrical receptacle having a sidewall and a flat floor and an interior volume of substantially constant circular cross-sectional configuration between said open top and said floor; and a semi-cylindrical open front storage compartment below and coaxially attached to the floor; the diameter of the semi-cylindrical storage compartment being substantially smaller than the smallest diameter of said receptacle;

said open front compartment having a base on which said device can stand; said base being of a diameter larger than the diameter than the semi-cylindrical storage compartment and spaced below said floor by about five inches so that said compartment can receive in an upright position on said base and beneath said floor therein at least one standard roll of toilet tissue.

2. A device as defined in claim 1 which is made of injection-molded plastic.

3. A device as defined in claim 1 which is of one-piece construction.

4. A device as defined in claim 1 wherein the waste receptacle has a flange periphery around the open top.

* * * * *